US007605539B2

(12) United States Patent
Woo et al.

(10) Patent No.: US 7,605,539 B2
(45) Date of Patent: Oct. 20, 2009

(54) PLASMA DISPLAY PANEL WITH REDUCED ELECTRODE DEFECT RATE

(75) Inventors: Seok-Gyun Woo, Suwon-si (KR); Won-Ju Yi, Suwon-si (KR); Kyoung-Doo Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 365 days.

(21) Appl. No.: 11/104,511

(22) Filed: Apr. 13, 2005

(65) Prior Publication Data

US 2005/0231110 A1 Oct. 20, 2005

(30) Foreign Application Priority Data

Apr. 19, 2004 (KR) ..... 10-2004-0026652

(51) Int. Cl.
*H01J 17/49* (2006.01)

(52) U.S. Cl. ..... 313/583; 313/582; 313/584; 313/585

(58) Field of Classification Search ..... 313/581, 313/582, 584, 585, 586, 587
See application file for complete search history.

(56) References Cited

U.S. PATENT DOCUMENTS

| | | | | |
|---|---|---|---|---|
| 5,371,437 | A * | 12/1994 | Amano | 315/169.1 |
| 5,420,601 | A * | 5/1995 | Amano | 345/60 |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,744,909 | A * | 4/1998 | Amano | 313/585 |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 6,873,105 | B2 * | 3/2005 | Akiba | 313/586 |
| 2004/0043693 | A1 * | 3/2004 | Ohkubo et al. | 445/24 |
| 2004/0145315 | A1 * | 7/2004 | Lin et al. | 313/584 |
| 2005/0046351 | A1 * | 3/2005 | Kweon | 313/582 |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-325888 | 11/2001 |

* cited by examiner

*Primary Examiner*—Joseph L Williams
*Assistant Examiner*—Fatima N Farokhrooz
(74) *Attorney, Agent, or Firm*—Robert E. Bushnell, Esq.

(57) ABSTRACT

A Plasma Display Panel (PDP) includes: a first substrate; a second substrate facing the first substrate; a first barrier rib of a dielectric material disposed between the first and second substrates, and defining discharge cells with the first and second substrates; upper discharge electrodes, each including an upper discharge unit disposed in the first barrier rib to surround the discharge cell and a terminal unit protruding from the first barrier rib; lower discharge electrodes, each including a lower discharge unit disposed in the first barrier rib to surround the discharge cell and a terminal unit protruding from the first barrier rib, the lower discharge electrodes respectively separated from the upper discharge electrodes; a first extension barrier rib supporting the lower terminal unit to be at the same height as the lower discharge units; a phosphor layer disposed in the discharge cells; and a discharge gas filling the discharge cells.

10 Claims, 4 Drawing Sheets

PLASMA DISPLAY PANEL WITH REDUCED ELECTRODE DEFECT RATE

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 19 Apr. 2004 and there, duly assigned Serial No. 10-2004-0026652.

BACKGROUND OF THE INVENTION

1. Field of the Invention

The present invention relates to a Plasma Display Panel (PDP) which displays an image using a gas discharge.

2. Description of the Related Art

An apparatus using a Plasma Display Panel (PDP) has a large screen with characteristics such as a high image quality, ultra-thin shape, light weight, and wide viewing angle. In addition, the PDP can be fabricated in simple way, and it is easy to enlarge the panel. Thus, the PDP is highlighted as a next generation flat panel display device.

PDPs can be classified into Direct Current (DC) PDPs, Alternating Current (AC) PDPs, and hybrid PDPs according to the driving method thereof. In addition, PDPs can also be classified into opposing discharge PDPs and surface discharge PDPs according to their discharge structure. AC PDPs having a three-electrode and surface discharge structure have become popular.

A three-electrode type surface discharge PDP includes a first substrate and a second substrate facing the first substrate.

On a lower surface of the first substrate, common electrodes and scan electrodes forming discharge gaps with the common electrodes are formed. The common and scan electrodes are covered by a first dielectric layer. A protective layer is formed on a lower surface of the first dielectric layer.

In addition, address electrodes are formed on an upper substrate of the second substrate so as to cross the common and scan electrodes, and the address electrodes are covered by a second dielectric layer. Barrier ribs are formed on an upper surface of the second dielectric layer to be separated by predetermined intervals from each other, in order to define discharge spaces. Phosphor layers are respectively formed in the discharge spaces, and a discharge gas is filled in the discharge spaces.

In the PDP having the above structure, plasma generated by the discharge emits ultraviolet rays in the discharge space. The ultraviolet rays excite the phosphor layer, and the excited phosphor layer emits visible rays, thus an image is displayed.

However, since the electrodes, the first dielectric layer, and the protective layer are sequentially formed from the lower portion of the first substrate, about 40% of the visible rays emitted from the phosphor layer is absorbed by the layers, thus reducing the light emission efficiency. Moreover, when the same image is displayed for a long time, charged particles of the discharge gas are ion-sputtered on the phosphor layer by the electric field, thereby causing a permanent residual image and reducing a lifespan of the PDP.

SUMMARY OF THE INVENTION

The present invention provides a Plasma Display Panel (PDP) operating with a low voltage, and improved brightness and light emission efficiency.

The present invention also provides a PDP capable of reducing an electrode defect rate by preventing disconnection of discharge electrodes from occurring.

According to an aspect of the present invention, a Plasma Display Panel (PDP) is provided comprising: a first substrate; a second substrate facing the first substrate; a first barrier rib of a dielectric material disposed between the first and second substrates, and defining discharge cells with the first and second substrates; upper discharge electrodes, each including an upper discharge unit disposed in the first barrier rib to surround the discharge cell and a terminal unit protruding from the first barrier rib; lower discharge electrodes, each including a lower discharge unit disposed in the first barrier rib to surround the discharge cell and a terminal unit protruding from the first barrier rib, the lower discharge electrodes respectively separated from the upper discharge electrodes; a first extension barrier rib supporting the lower terminal unit to be at the same height as the lower discharge units; a phosphor layer disposed in the discharge cells; and a discharge gas filling the discharge cells.

The first extension barrier rib is preferably arranged between the lower terminal unit and the first substrate.

The first extension barrier rib preferably extends from the first barrier rib.

The PDP preferably further comprises a second extension barrier rib arranged between the upper terminal unit and the first substrate to arrange the upper terminal unit to be at the same height as the upper discharge unit.

The second extension barrier rib preferably extends from the first barrier rib.

The PDP preferably further comprises an MgO layer covering side surfaces of the first barrier rib.

The upper discharge electrode preferably extends in a predetermined direction, and the lower discharge electrode preferably extends in a direction crossing the extended direction of the upper discharge electrode.

The upper and lower discharge electrodes preferably respectively extend in parallel in a predetermined direction, and address electrodes are preferably arranged in the discharge cells to extend in a direction crossing the extended direction of the upper and lower discharge electrodes.

The PDP preferably further comprises a dielectric layer disposed between the second substrate and the phosphor layer to cover the address electrodes.

The upper discharge electrode preferably functions as a common electrode, and the lower discharge electrode preferably functions as a scan electrode.

The PDP preferably further comprises a second barrier rib defining the discharge cells with the first barrier rib and a phosphor layer arranged on a space defined by the second barrier rib, the second barrier rib arranged between the first barrier rib and the second substrate.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
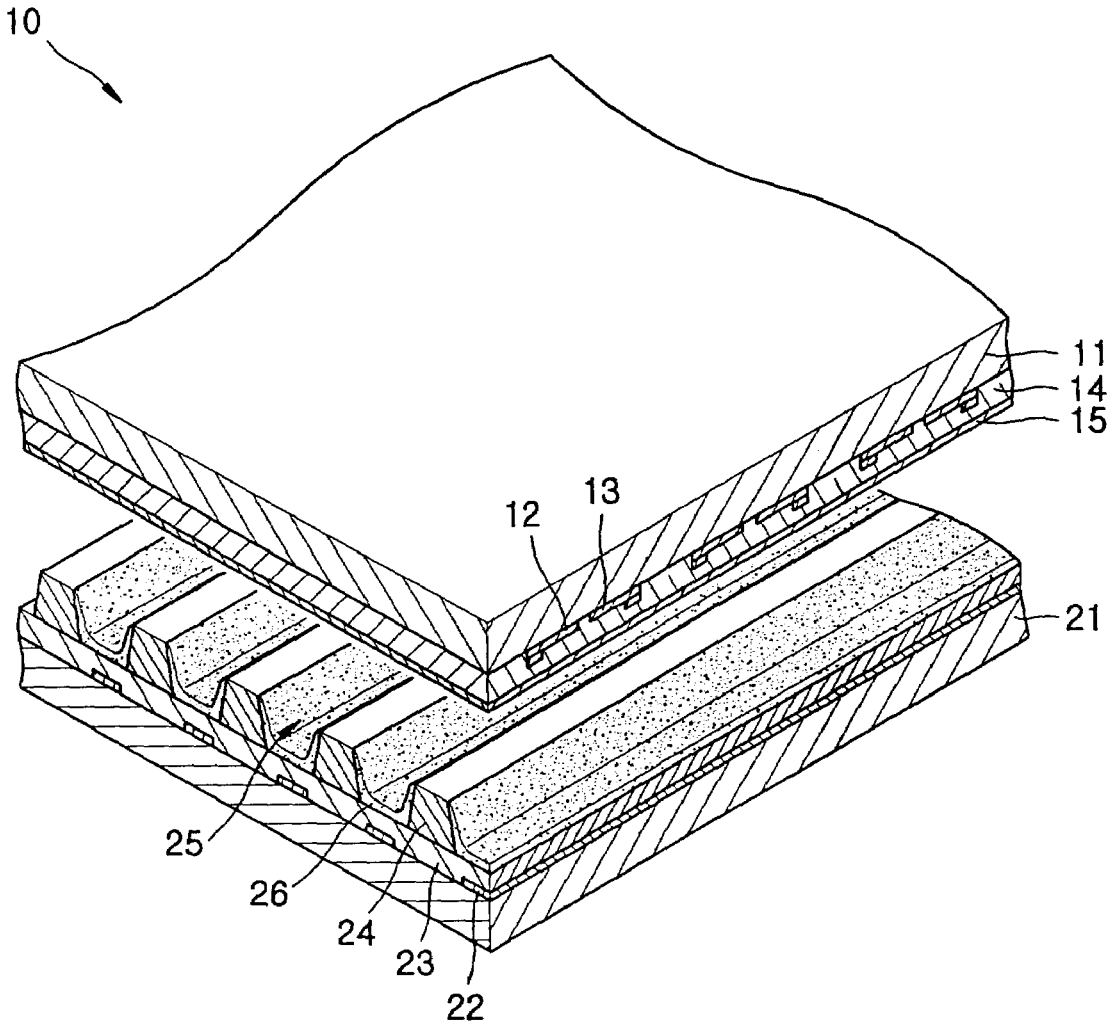
FIG. 1 is a partial perspective view of a Plasma Display Panel (PDP)

FIG. 1 is a perspective view of a three-electrode type surface discharge Plasma Display Panel (PDP).

The PDP 10 includes a first substrate 11 and a second substrate 21 facing the first substrate 11.

Common electrodes 12 and scan electrodes 13 forming discharge gaps with the common electrodes 12 are arranged on a lower surface of the first substrate 11. The common and scan electrodes 12 and 13 are covered by a first dielectric layer 14. A protective layer 15 is arranged on a lower surface of the first dielectric layer 14.

In addition, address electrodes 22 are arranged on an upper substrate of the second substrate 21 so as to cross the common and scan electrodes 12 and 13. The address electrodes 22 are covered by a second dielectric layer 23. Barrier ribs 24 are arranged on an upper surface of the second dielectric layer 23 and are separated from each other by predetermined intervals to define discharge spaces 25. Phosphor layers 26 are respectively arranged in the discharge spaces 25, and the discharge spaces 25 are filled with a discharge gas.

In the PDP 10 having the above structure, a plasma generated by the discharge emits ultraviolet rays in the discharge space 25. The ultraviolet rays excite the phosphor layer 26, and the excited phosphor layer 26 emits visible rays, thus forming a displayed image.

However, since the electrodes 12 and 13, the first dielectric layer 14, and the protective layer 15 are sequentially arranged from the lower portion of the first substrate 11, about 40% of the visible rays emitted by the phosphor layer 26 is absorbed by these layers, thus reducing the light emission efficiency. Moreover, when the same image is displayed for a long time, charged particles of the discharge gas are ion-sputtered on the phosphor layer 26 by the electric field, thus causing a permanent residual image and reducing a lifespan of the PDP.

FIGS. 2 through 5 are views of a PDP according to an embodiment of the present invention.

Figure 2:
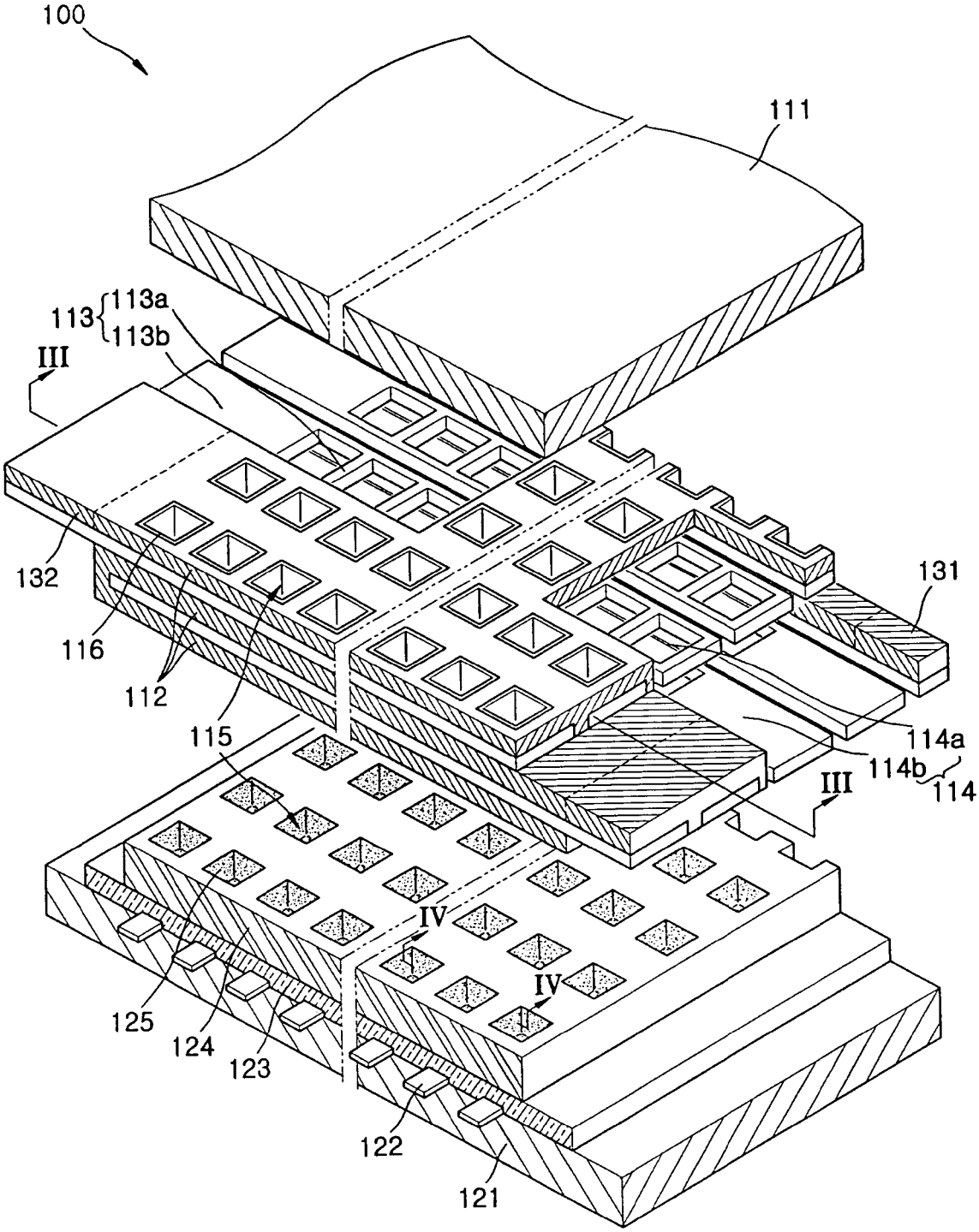
FIG. 2 is a partial perspective view of a PDP according to an embodiment of the present invention.
Figure 3:
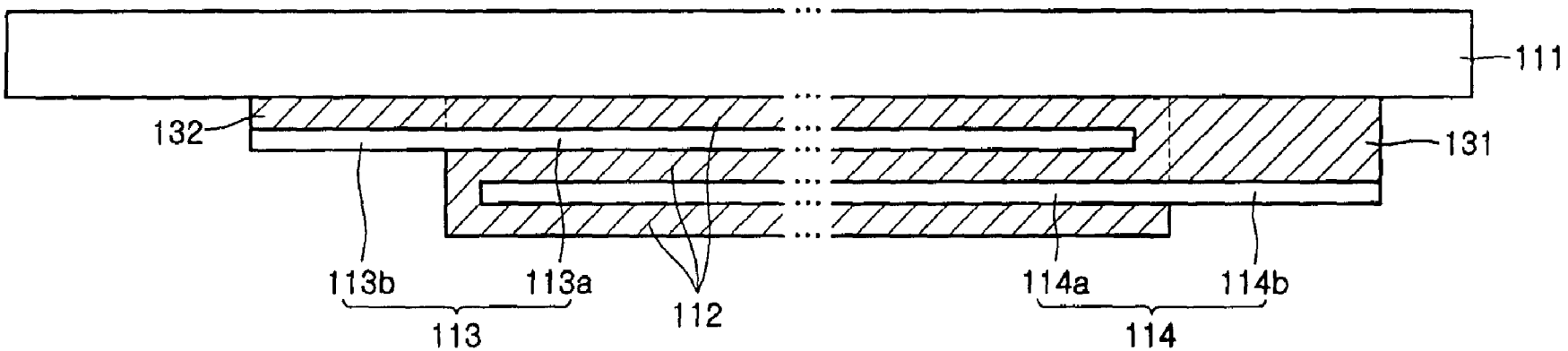
FIG. 3 is a partial cross-sectional view of the PDP along line III-III of FIG. 2.

Referring to FIG. 2, the PDP 100 includes a first substrate 111, and a second substrate 121 facing the first substrate 111.

The first and second substrates 111 and 121 are formed of a light-transmittance material such as a glass. It is particularly desirable for the first substrate 111 to have a superior light-transmittance since an image is displayed through the first substrate 111. In addition, a first barrier rib 112 and a second barrier rib 124 are arranged in predetermined patterns between the first and second substrates 111 and 121.

In FIG. 2, the first barrier rib 112 and the second barrier rib 124 are respectively formed as closed barrier ribs having transverse cross-sections of a matrix structure. In addition, a lower surface of the first barrier rib 112 corresponds to an upper surface of the second barrier rib 124. Thus, a space defined by the first barrier rib 112 corresponds to a space defined by the second barrier rib 124.

However, the first and second barrier ribs can be formed as closed barrier ribs of a waffle structure, or the transverse cross-section of the barrier ribs can be formed as a polygon such as a triangle or a pentagon, a circular shape, or an oval shape with closed edges. Otherwise, a combination of various barrier ribs can be formed, for example, the first barrier rib can be formed as a closed barrier rib, and the second barrier rib can be formed as open barrier rib, such as stripe.

Figure 4:
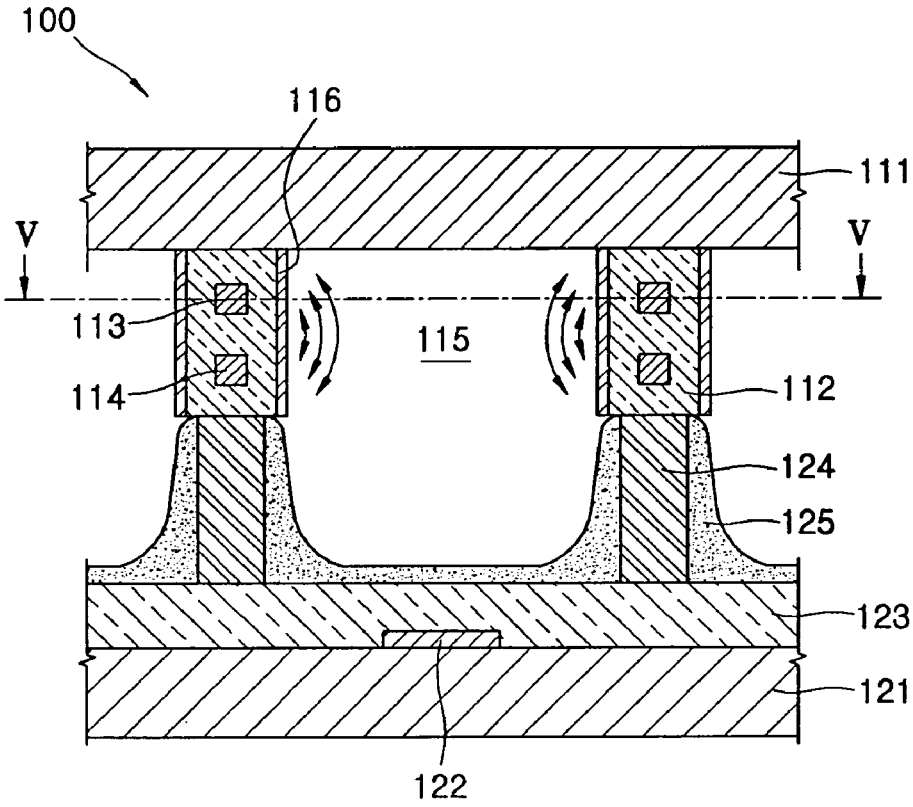
FIG. 4 is a cross-sectional view of a unit discharge cell along line IV-IV of FIG. 2.
Figure 5:
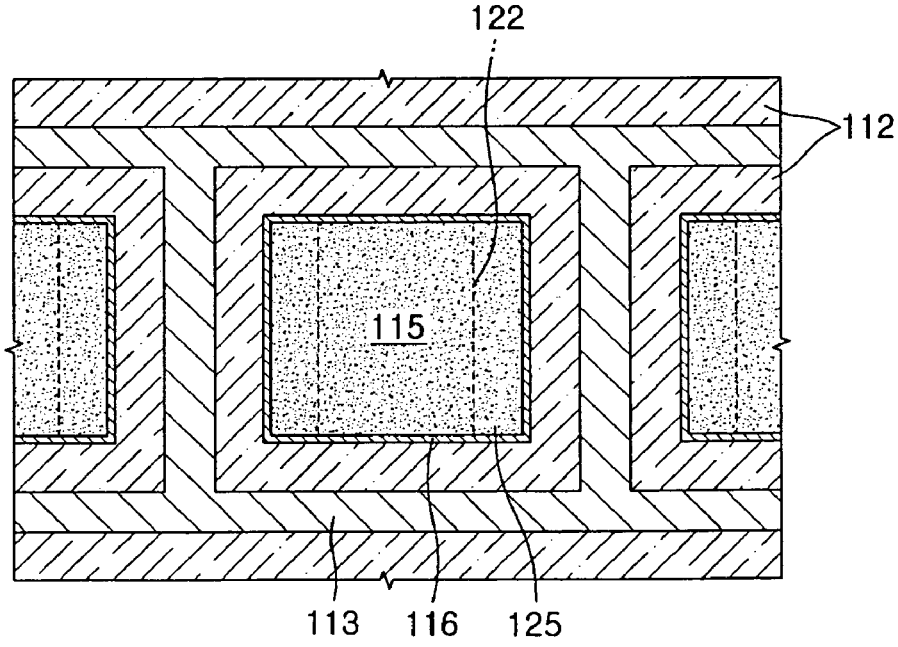
FIG. 5 is a cross-sectional view of the unit discharge cell along line V-V of FIG. 4.

The first and second barrier ribs 112 and 124 defined is charge cells 115 shown in FIG. 4 corresponding to a sub-pixel among red, green, and blue color sub-pixels that constitute a unit pixel for realizing colors, and prevent cross-talk between the discharge cells 115. The first barrier rib 112 and the second barrier rib 124 can be formed separately, or integrally using the same material.

A discharge gas, such as a mixed gas including Ne and Xe, fills the discharge cells 115 defined by the first and second barrier ribs 112 and 124.

In addition, address electrodes 122 are arranged on the upper surface of the second substrate 121 disposed under the second barrier rib 124, and the address electrodes 122 are covered by a dielectric layer 123. The address electrodes 122 respectively correspond to the discharge cells 115 so that the discharge cell 115 which will start the discharge can be selected. Although the address electrodes 122 are formed in stripes, the arrangement of the address electrodes 122 is not limited thereto.

The dielectric layer 123 prevents positive ions or electrons from damaging the address electrodes 122 due to collisions of the ions or electrons with the address electrodes 122 during the discharge, and induces electric charges. The dielectric layer 123 can be formed of a dielectric material, such as PbO, $B_2O_3$, and $SiO_2$.

In addition, a phosphor layer 125, excited by ultraviolet rays generated during a sustain discharge to emit visible light rays, is disposed in the discharge cell 115.

Referring to FIG. 4, the phosphor layer 125 is arranged on the space defined by the second barrier rib 124, that is, the upper surface of the dielectric layer 123 and the sides of the second barrier rib 124.

The phosphor layer 125 includes a fluorescent material that is excited by the ultraviolet rays generated in the discharge operation to emit red, green, and blue color visible light rays, respectively. For example, the phosphor layer arranged on the discharge cell corresponding to the red color sub-pixel includes a fluorescent material such as $Y(V,P)O_4$:Eu, the phosphor layer arranged in the discharge cell corresponding to the green color sub-pixel includes a fluorescent material such as $Zn_2SiO_4$:Mn and $YBO_3$:Tb, and the phosphor layer arranged in the discharge cell corresponding to the blue color sub-pixel includes the fluorescent material such as BAM:Eu.

Since the phosphor layer 125 is arranged on the space defined by the second barrier rib 124, it is noticeably separated from the space of the first barrier rib 112, where the sustain discharge occurs. Therefore, the ion-sputtering of the phosphor layer 125 by the charged particles can be prevented, and the generation of permanent residual images can be greatly reduced even when the same image is displayed for a long time.

In the first barrier rib 112 defining the discharge cell 115 with the second barrier rib 124, an upper discharge electrode 113 and a lower discharge electrode 114 that generate the discharge in the each discharge cell 115 are arranged as shown in FIG. 2. The upper discharge electrode 113 is disposed at an upper portion, that is, adjacent to the first substrate 111, and the lower discharge electrode 114 is disposed under the upper discharge electrode 113. The upper and lower discharge electrodes 113 and 114 can be formed of a conductive metal, such as aluminum and copper. Accordingly, these electrodes 113 and 114 have a lower resistance than that of an electrode formed of Indium Tin Oxide (ITO). Thus, a discharge response speed can be faster than that of a PDP using ITO electrodes.

In addition, the first barrier rib 112 embedding the upper and lower discharge electrodes 113 and 114 is formed of a dielectric material. Accordingly, a direct electric connection between the upper and lower discharge electrodes 113 and 114 is prevented, the charged particles do not directly collide with the upper and lower discharge electrodes 113 and 114 in the discharge operation, and the charged particles are induced for easily accumulating wall charges. The first barrier rib 112 can be formed of a dielectric material, such as PbO, $B_2O_3$, and $SiO_2$.

The upper discharge electrodes 113, disposed on upper portion in the first barrier rib 112, extends along the discharge cells 115 that cross the address electrodes 122 at a right angle. One upper discharge electrode 113 is formed as a ladder as shown in FIG. 2, and the upper discharge electrode 113 includes an upper discharge unit 113*a* surrounding four sides of the discharge cell 115 arranged in a direction of crossing the address electrode 122, and an upper terminal unit 113*b* extends from the upper discharge unit 113*a* toward an edge of the first substrate 111 to supply voltage to the upper discharge unit 113*a*.

The upper discharge electrodes 113 are disposed along the address electrodes 122 at predetermined intervals. In addition, the side portions of the upper discharge electrodes 113, which are separated from each other, are commonly disposed in the first barrier rib 112 that is arranged along the direction of crossing the address electrodes 122. However, the arrangement is not limited to the above example, and the first barrier ribs can be formed in a dual-layered structure so that the side portion is disposed at each barrier rib.

The lower discharge electrodes 114, separated from the upper discharge electrodes 113 and located under the upper discharge electrodes 113 in the first barrier ribs 112, can be arranged in parallel to the upper discharge electrodes 113. That is, the lower discharge electrodes 114 extends as ladder shapes along the discharge cells 115 that cross the address electrodes 122 at a right angle, and one lower discharge electrode 114 includes a lower discharge unit 114*a* surrounding four sides of the discharge cell 115 and supporting the discharge operation, and a lower terminal unit 114*b* extends from the lower discharge unit 114*a* toward the edge of the first substrate 111 to supply a voltage to the lower discharge unit 114*a*.

In addition, the lower discharge electrodes 114 are separated at predetermined intervals from each other along the address electrodes 122, and the separated sides of the lower discharge electrodes are commonly disposed in the first barrier rib 112 that cross the address electrodes 122 at a right angle.

As described above, the upper discharge unit 113*a* of the upper discharge electrode 113 and the lower discharge unit 114*a* of the lower discharge electrode 114, which surround the four sides of the each discharge cell 115 and are separated from each other with a predetermined discharge gap, are disposed at the discharge cell 115. Thus, the discharge area where the discharge occurs can be expanded to the boundary of the discharge cell 115, and the light emission efficiency can be improved.

The upper discharge unit 113*a* of the upper discharge electrode 113 and the lower discharge unit 114*a* of the lower discharge electrode 114, disposed at each discharge cell 115, are symmetric with each other in an up-and-down direction. However, these can be arranged asymmetrically. In addition, the upper and lower discharge electrodes are formed as closed electrodes so as to surround the four sides of the discharge cell. However, the present invention is not limited thereto.

In the lower discharge electrode 114, the lower discharge unit 114*a* is embedded by the first barrier rib 112, and the lower terminal unit 114*b* protrudes outward from the first barrier rib 112. Accordingly, the lower terminal unit 114*b* and the first substrate 111 are separated by a predetermined gap, and a first extension barrier rib 131 is disposed between the lower terminal unit 114*b* and the first substrate 111.

In more detail, the first extension barrier rib 131 is arranged between the first substrate 111 and the lower terminal unit 114*b*, and extends from the barrier rib 112 toward the edge of the first substrate 111. In addition, the lower terminal unit 114*b* is disposed on the lower surface of the first extension barrier rib 131. Accordingly, the lower terminal unit 114*b* can be supported by a surface of the first extension barrier rib 131. Thus, the lower terminal unit 114*b* can be located at the same height as the lower discharge unit 114*a*, which minimizes bending between the lower discharge unit 114*a* and the lower terminal unit 114*b* and accordingly, a disconnection does not occur.

When the lower terminal unit 114*b* is disposed as described above, bending distortion of the lower terminal unit 114*b* hardly occurs, and the disconnection of the lower terminal unit 114*b* can be prevented. Accordingly, the defect rate of the electrode can be reduced.

In the drawings, the first extension barrier rib 131 is formed up to the lower surface of the first substrate 111. However, the first extension barrier rib 131 is not limited thereto if it has a height supporting the lower terminal unit. In addition, the first extension barrier rib 131 is integrally formed by being extended from the first barrier rib 112. However, the first extension barrier rib 131 can be formed separately from the first barrier rib 112.

In addition, the lower surface of the lower terminal unit 114*b* is exposed to the outside, and the exposed portion of the lower terminal unit 114*b* is connected to a circuit unit for the lower discharge electrode using a signal transmission unit as a medium. Thus, the voltage is supplied to the lower discharge electrode 114 from the circuit unit.

The upper discharge unit 113*a* of the upper discharge electrode 113 is embedded by the first barrier rib 112, and the upper terminal unit 113*b* is exposed to the outside. The upper terminal unit 113*b* extends toward the opposite direction of the lower terminal unit 114*b*.

Accordingly, the upper terminal unit 113*b* and the first substrate 111 are separated by a predetermined interval, and a second extension barrier rib 132 is disposed between the upper terminal unit 113*b* and the first substrate 111.

The upper terminal unit 113*b* is disposed on a lower surface of the second extension barrier rib 132. Thus, the upper terminal unit 113*b* is supported by the second extension barrier rib 132, and the upper terminal unit 113*b* is located at the same height as the upper discharge unit 113*a*. Accordingly, the disconnection of the upper terminal unit 113*b* is prevented, and the defect rate of the electrode can be reduced. When the separated distance between the upper terminal unit and the first substrate is short and the disconnection of upper terminal unit is not likely to occur, the second extension barrier rib can be omitted.

A lower surface of the upper terminal unit 113*b* is exposed to the outside and connected to a circuit unit for the upper discharge electrode using the signal transmission unit as a medium. Thus, the voltage is supplied to the upper discharge electrode 113 from the circuit unit.

One of the upper and lower discharge electrodes 113 and 114 corresponds to a common electrode, and the other corresponds to a scan electrode. Therefore, the charged particles are moved in an up-and-down direction by a sustain voltage alternately supplied between the upper and lower discharge electrodes 113 and 114. Thus, the sustain discharge occurs.

It is desirable that the lower discharge electrode 114 functions as the scan electrode, since the address voltage supplied between the lower discharge electrode 114 and the address electrode 122 can be lowered and the address discharge generated.

The address electrode 122 causing the address discharge accumulates the electric charges on the upper discharge electrode 113 and the lower discharge electrode 114 when the address discharge is suspended, thereby causing the sustain discharge between the upper and lower discharge electrodes 113 and 114. Accordingly, the initial voltage of the sustain discharge can be lowered. In addition, when the address electrode is omitted, the upper and lower discharge electrodes should be arranged to cross each other so that the discharge cell is selected and the discharge can be performed.

An MgO layer 116 of a predetermined thickness is arranged on a side of the first barrier rib 112. When the MgO layer 116 is formed, the direct collision of the charged particles generated during the discharge onto the first barrier rib 112 is prevented by the MgO layer 116. Thus, the damage of first barrier rib 112 due to the ion-sputtering of the charged particles can be prevented. Moreover, when the charged particles directly collide with the MgO layer 116, secondary electrons that contribute to the discharge can be emitted from the MgO layer 116. Therefore, the panel can operate with a low voltage, and the light emission efficiency can be improved.

The operation of the PDP 100 having the above described structure is as follows. When the address voltage is supplied between the address electrode 122 and the lower discharge electrode 114 functioning as the scan electrode to generate the address discharge, the discharge cell 115, on which the sustain discharge will occur, is selected by the result of the address discharge. After the address discharge, the sustain discharge voltage is alternately supplied between the upper and lower discharge electrodes 113 and 114 disposed in the selected discharge cell 115. A sustain discharge then occurs between the upper and lower discharge electrodes 113 and 114. In addition, an energy level of the discharge gas excited by the sustain discharge is lowered to emit the ultraviolet rays. The ultraviolet rays excite the phosphor layer 125 arranged in the discharge cell 115, and the excited phosphor layer 125 emits the visible light rays to display an image.

The sustain discharge generated between the upper and lower discharge electrodes 113 and 114 is concentrated on the upper portion of the discharge cell 115, and the sustain discharge occurs perpendicular to all sides defining the discharge cell 115. In addition, the sustain discharge occurring from all of the sides of the discharge cell 115 occurs toward the center portion of the discharge cell 115.

Therefore, the discharge area becomes relatively larger than that of the panel of FIG. 1, a volume of the area where the sustain discharge occurs can be increased, and a space charge in the discharge cell that is not normally used can contribute to the light emission. Accordingly, the amount of plasma generated during the discharge is increased.

As described above, the PDP according to the present invention has the following effects.

Since the discharge occurs on all sides of the discharge cell, the discharge area increases greatly, and the panel can operate with a low voltage. Moreover, even if the discharge gas includes Xe gas at a high content ratio, the panel can operate with a low voltage, and accordingly, the light emission efficiency can be improved.

In addition, the extension barrier rib extends from the first barrier rib covering the discharge area is further arranged between the terminal unit of the discharge electrode and the first substrate, especially between the terminal unit of the lower discharge electrode and the first substrate. Therefore, the terminal unit can be supported without being bent and the disconnection of the terminal unit can be prevented. Thus, the electrode defect rate can be lowered.

Also, since the phosphor layer disposed on the lower portion of the discharge cell is separated from the area where the sustain discharge occurs, the ion-sputtering of the phosphor layer due to the charged particles can be prevented, and the lifespan of the panel is increased.

While the present invention has been particularly shown and described with reference to exemplary embodiments thereof, it will be understood by those of ordinary skill in the art that various modifications in form and detail may be made therein without departing from the spirit and scope of the present invention as defined by the following claims.

What is claimed is:

1. A Plasma Display Panel (PDP) comprising:

a first substrate;

a second substrate facing the first substrate;

a first barrier rib of a dielectric material disposed between the first and second substrates, and defining discharge cells with the first and second substrates;

upper discharge electrodes, each including an upper discharge unit disposed in the first barrier rib to surround the discharge cell and a terminal unit protruding from the first barrier rib;

lower discharge electrodes, each including a lower discharge unit disposed in the first barrier rib to surround the discharge cell and a terminal unit protruding from the first barrier rib, the lower discharge electrodes respectively separated from the upper discharge electrodes;

a first extension barrier rib, separated from the first and second substrates, arranged between the lower terminal unit and the first substrate and completely covers the lower discharge electrodes, to support the lower terminal unit to be in a same plane as the lower discharge units to prevent bending of the lower terminal unit;

a phosphor layer disposed in the discharge cells; and a discharge gas filling the discharge cells.

2. The PDP of claim 1, wherein the first extension barrier rib is arranged between the lower terminal unit and the first substrate.

3. The PDP of claim 1, wherein the first extension barrier rib extends from the first barrier rib.

4. The PDP of claim 1, further comprising a second extension barrier rib, separated from the first and second substrates, arranged between the upper terminal unit and the first substrate and completely covers the upper discharge electrodes, to support the upper terminal unit to be in a same plane as the upper discharge units to prevent bending of the upper terminal unit.

5. The PDP of claim 1, further comprising an MgO layer covering side surfaces of the first barrier rib.

6. The PDP of claim 1, wherein the upper discharge electrode extends in a predetermined direction, and the lower discharge electrode extends in a direction crossing the extended direction of the upper discharge electrode.

7. The PDP of claim 1, wherein the upper and lower discharge electrodes respectively extend in parallel in a predetermined direction, and wherein address electrodes are arranged in the discharge cells to extend in a direction crossing the extended direction of the upper and lower discharge electrodes.

8. The PDP of claim 1, further comprising a second barrier rib defining the discharge cells with the first barrier rib and a phosphor layer arranged on a space defined by the second barrier rib, the second barrier rib arranged between the first barrier rib and the second substrate.

9. The PDP of claim 4, wherein the second extension barrier rib extends from the first barrier rib.

10. The PDP of claim 7, further comprising a dielectric layer disposed between the second substrate and the phosphor layer to cover the address electrodes.

* * * * *